US005395103A

United States Patent [19]

Gysi et al.

[11] Patent Number: 5,395,103

[45] Date of Patent: Mar. 7, 1995

[54] PROCESS FOR REMOVING INDIVIDUAL METAL SHEETS FROM A STACK AND DEVICE FOR CARRYING OUT THE PROCESS

[75] Inventors: Peter Gysi, Bellikon; Armin Ineichen, Wohlen, both of Switzerland

[73] Assignee: Elpatronic AG, Zug, Switzerland

[21] Appl. No.: 50,548

[22] Filed: Apr. 20, 1993

[30] Foreign Application Priority Data

May 25, 1992 [CH] Switzerland ..... 01671/92

[51] Int. Cl.[6] ..... B65H 5/08

[52] U.S. Cl. ..... 271/11; 271/10; 271/99; 414/797.8

[58] Field of Search ..... 271/10, 11, 18.1, 91, 271/99, 102, 107, 12, 13, 15; 414/796.7, 797, 797.1, 797.8

[56] References Cited

U.S. PATENT DOCUMENTS

| | | | |
|---|---|---|---|
| 3,718,328 | 2/1973 | Comstock | 271/99 |
| 3,724,687 | 4/1973 | Marschke et al. | 271/11 |
| 3,887,177 | 6/1975 | Farfaglia et al. | 271/12 |
| 3,937,458 | 2/1976 | Langen | 271/99 |
| 4,002,332 | 1/1977 | Hoenigmann | 271/11 |
| 4,129,294 | 12/1978 | Marass | 271/107 |
| 4,154,438 | 5/1979 | Seragnoli | 271/12 |
| 4,350,466 | 9/1982 | Bahr et al. | 414/797.8 |
| 4,516,763 | 5/1985 | Stahl et al. | 271/11 |
| 4,518,301 | 5/1985 | Greenwell | 414/797.8 |
| 4,728,766 | 3/1988 | Opprecht et al. . | |
| 5,031,892 | 7/1991 | Stieger . | |
| 5,152,521 | 10/1992 | Itakura | 271/11 |

FOREIGN PATENT DOCUMENTS

| | | |
|---|---|---|
| 1140657 | 8/1957 | France . |
| 1047216 | 12/1958 | Germany . |
| 3420839 | 12/1985 | Germany . |

*Primary Examiner*—H. Grant Skaggs

[57] ABSTRACT

Two sheets (10,14) are removed simultaneously from the sheet stack (1). While one sheet (10) is already in the transfer position, from which it is introduced into the conveyor line by two feed rolls (7,8), a first suction element (20) seizes the next sheet (14) from the stack (1). This sheet is moved along the curve a into the now vacated transfer position. A second suction element (30), which is no longer needed to hold the first sheet (10) there, moves to the stack (1) to seize the next sheet (15) and bring it to the transfer position, while the first suction element moves back to the stack. In this way, destacking can proceed at a faster rate than hitherto.

10 Claims, 2 Drawing Sheets

PROCESS FOR REMOVING INDIVIDUAL METAL SHEETS FROM A STACK AND DEVICE FOR CARRYING OUT THE PROCESS

BACKGROUND OF THE INVENTION

The invention relates to a process for removing individual metal sheets from a stack by means of at least one destacking member which seizes the sheet, and for feeding the sheets into a conveyor line. The invention also relates to a device for carrying out the process, and an application of the process.

Known devices for removing sheets from a stack include those shown in FIG. 1 and FIG. 2. In the known device according to FIG. 1, sheets are drawn off one at a time by means of a vacuum arm from the sheet stack arranged above the vacuum arm. The known means for holding the stack of sheets are not shown in FIG. 1. To detach the sheet, the vacuum arm is raised. On then being lowered, the sheet is gripped by the suction cups connected to a vacuum line and is deposited on a transfer table. The suction cups are then released from the sheet and lowered a little further. A pusher arm then pushes the sheet sideways to the feed rolls which convey the sheet away. The destacking device which has just been described is complex and its working rate is limited. FIG. 2 shows another known configuration of a destacking device. In this device also a sheet is drawn off by means of a vacuum arm from a stack arranged above the vacuum arm. The vacuum arm then performs an arc-shaped movement by means of a parallelogram arm-suspension and crank drive, and thereby feeds the sheet to the feed rolls. After this step, the vacuum arm is raised again along the circular arc in order to draw off the next sheet. This arrangement is also limited in its working rate.

Especially in the case of can welding machines, in which the welding can nowadays be performed with very high production rates, there is a need for the individual sheets formed into can bodies and then welded to be supplied at high feed rates. In other applications also, it may be advantageous to use a destacking device with a high working rate.

SUMMARY OF THE INVENTION

It is therefore a basic object of the invention to provide a process and device for removing sheets which is capable of attaining very high working rates and which can be realized in a simple manner.

This is achieved in a process of the kind stated at the outset by having at least two sheets engaged in the removal process at any one time so that while one sheet is being positioned for drawing into the conveyor line the destacking member is moving to bring the next sheet to the feed position.

Since with one sheet located at the feed position the destacking member is already readying the next sheet, a substantial increase in the working rate can be achieved.

In a preferred way of carrying out the process, two destacking members are provided. While one destacking member is effecting the positioning, the other destacking member is already occupied in readying the next sheet. The two destacking members work in alternation. In another way of carrying out the invention, only one destacking member is provided, and this deposits each sheet on a table and then moves back to the stack to ready the next sheet.

BRIEF DESCRIPTION OF THE DRAWINGS

The state of the art, and embodiments of the invention given by way of example, will now be explained in detail with reference to the drawings, in which.

DESCRIPTION OF THE PREFERRED EMBODIMENTS

Figure 1:
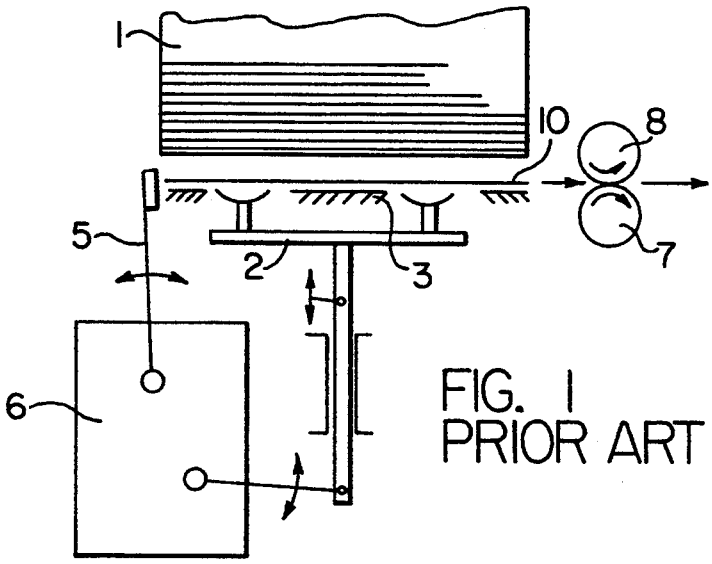
FIG. 1 PRIOR ART
FIG. 1 is a diagram showing a state-of-the-art destacker.

FIG. 1 shows a destacking device according to the state of the art. A vacuum arm 2 is arranged underneath the sheet stack 1, which is held by holding means not shown in the drawing. This vacuum arm can be driven up and down by the drive unit 6. When it is raised, the suction cups on the vacuum arm come into contact with the sheet stack 1. By creating a partial vacuum in the suction cups, these are made to grip the lowermost sheet in the stack. By then lowering the vacuum arm, the lowermost sheet 10 is drawn from the stack and placed on the transfer table 3. The sheet 10 is then released by the suction cups. A pusher arm which is driven by a drive unit 6 then pushes the sheet 10 to the feed rolls 7 and 8 which move the sheet away from the stack. The vacuum arm 2 is then raised again towards the sheet stack 1, to pull the next sheet from the stack.

Figure 2:
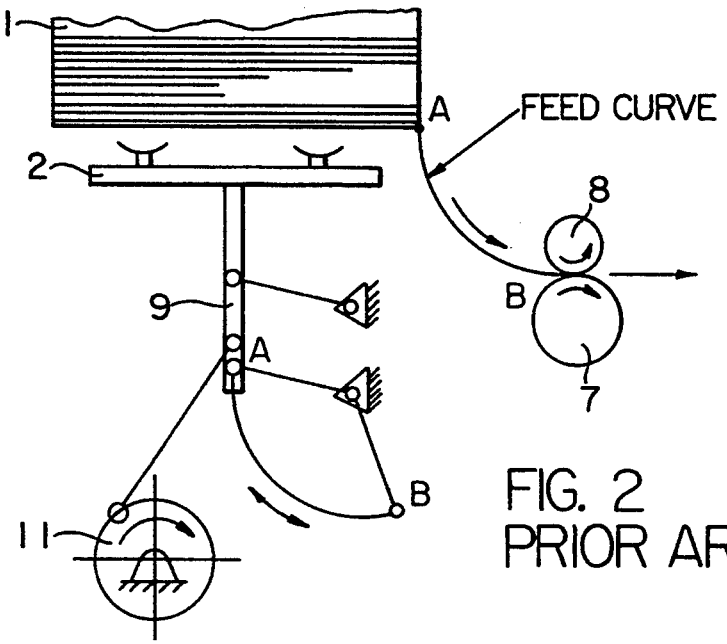
FIG. 2 PRIOR ART
FIG. 2 shows another known destacker.

FIG. 2 shows another destacking device according to the state of the art. In FIG. 2, similar parts are designated by the same reference numbers as in FIG. 1. The vacuum arm 2 in this device is attached to an arm guide 9 which can be moved over a circular path by a parallelogram suspension and a crank drive 11. The vacuum arm 2 similarly moves along a circular path. The sheet drawn from the stack 1 by the vacuum arm 2 is fed by the vacuum arm 2 to the feed rolls 7 and 8. The sheet is then conveyed on its way by the feed rolls. After the sheet has been conveyed away by the feed rolls, the vacuum arm 2 makes another upward movement to the sheet stack 1 to draw the next sheet from the stack.

Figure 3:
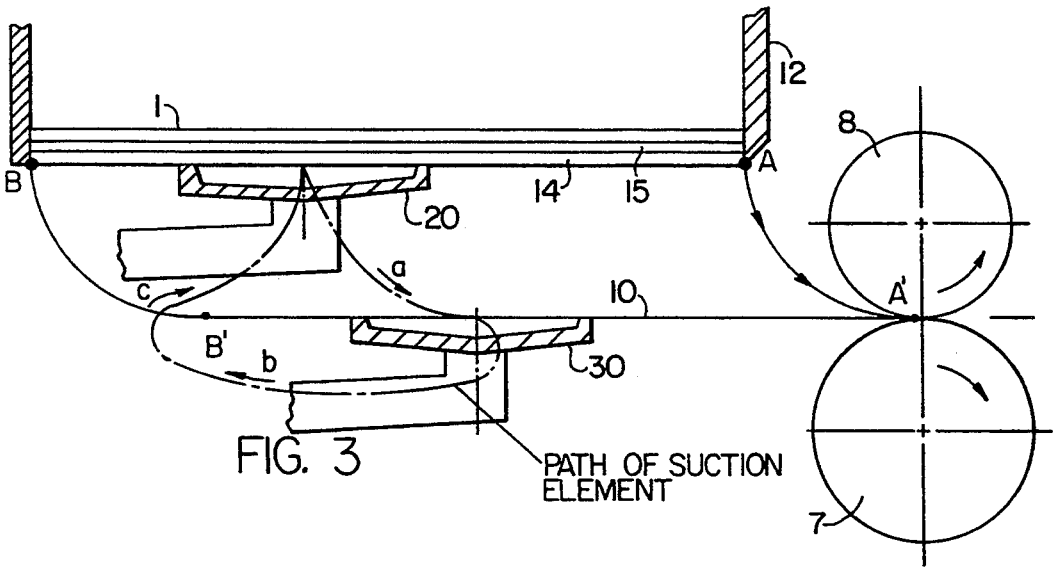
FIG. 3 diagrammatically shows a first embodiment of a destacker for carrying out the process according to the invention.

FIG. 3 shows a first embodiment for carrying out the process according to the invention. Similar parts to those in the previous figures are again designated with the same reference numbers. The sheet stack 1 is held in a stack guide 12. As this is of a known type, it will not be described here. Two suction elements 20 and 30 are provided in the device illustrated. Each of these suction elements 20,30 is able to carry an individual one of the sheets. In the position illustrated in FIG. 3, one suction element 20 is in contact with the underside of the sheet stack 1 and grips the lowermost sheet 14 of the stack. Gripping is again effected by the creation of a partial vacuum in the suction element. Electromagnetic or mechanical grippers can also be used. The other suction element 30 is located at this time in this transfer position for the sheet 10 which it holds and which is drawn into the conveyor line by the feed rolls 7 and 8. In this position the suction element carries the sheet 10 without holding it by suction, to allow the rolls 7 and 8 to draw the sheet off. The first suction element 20 now starts to move the sheet 14 which it holds, downwards along the curve a. The edge of the sheet 14 nearest the draw-off rolls describes the path indicated at A-A', while the edge of the sheet 14 furthest away from the draw-off rolls describes the path indicated at B-B'. While one suction element is on its way to the transfer position with the sheet 14, the second suction element 30 is no longer required to hold the sheet 10 being transferred. This suction element 30 is now moved back and away from the feed rolls along the curve b and then upwards along the curve c to fetch another sheet 15 from the stack. On this path along the curve b, c, the suction element 30 goes around the sheet 14 which is being taken to the transfer position by the first suction element 20. The process is then repeated. The sheet 14 is supported by the suction element 20 without suction until a sufficient length of the sheet has been taken hold of by the feed rolls. Meanwhile the suction element 30 seizes the sheet 15 from the stack and likewise moves downwards along the curve a to the draw-in position. The suction element 20, after its sheet 14 has been picked up, in turn moves upwards again along the curves b, c to the stack 1. It will be immediately apparent that a considerably higher rate of sheet feed to the conveyor line can be obtained in this way, as two suction elements are operating simultaneously. The mechanism for driving the suction elements 20 and 30 along the curves a, b, c is not shown. Such a drive mechanism can be provided in a variety of known forms, e.g. as a hydraulic or electric drive.

Figure 4:
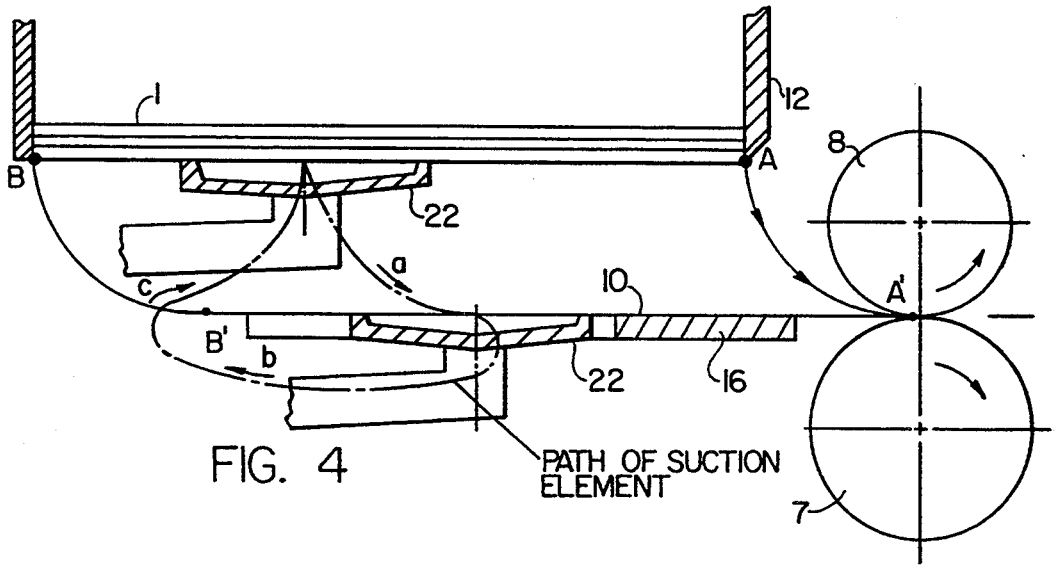
FIG. 4 shows another embodiment of a destacker for carrying out the process according to the invention.

FIG. 4 shows another embodiment of a destacking device for carrying out the process. In this device only a single suction element 22 is provided. A transfer table 16 for the sheet is provided at the transfer position. The destacking sequence for this device is as follows. The suction element 22 grips the lowermost sheet of the stack 1. This sheet is brought to the feed rolls 7 and 8 by the suction element 22, as already described in the previous embodiment. The difference from the previous embodiment lies in the fact that the sheet is supported by the table 16 at this transfer position so that the suction element 22 can be moved directly back to the stack 1 along the curves b and c without continuing to support the sheet 10 during its transfer. This embodiment also affords an increase in the working rate, as here again two sheets are involved in the stacking process: while one sheet is already in the transfer position, the next sheet is being made ready as the suction element is moved towards it.

Figure 5:
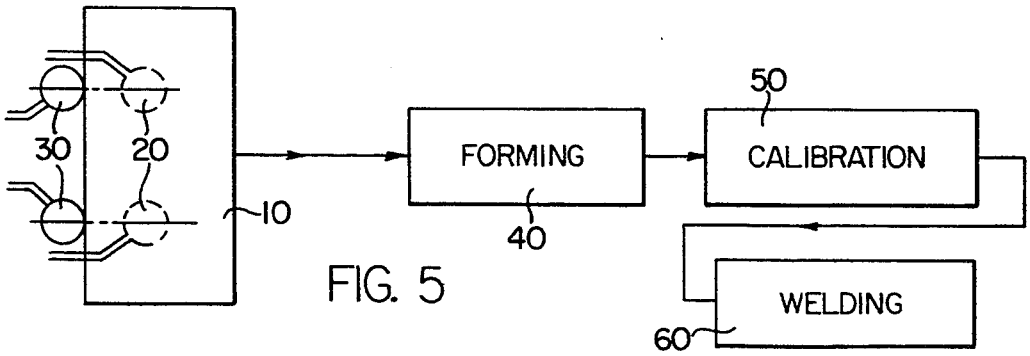
FIG. 5 is a diagram showing the application of a destacker according to the invention to a can welding machine.

FIG. 5 diagrammatically shows the application of such a destacking device to the welding of can bodies. The sheets, of which the sheet 10 is shown, are fed by the suction elements 20 and 30 to the conveyor line where they pass into a forming station 40 which preforms the can body and then into a calibration station which sets the can body to the required size and then into the welding station 60 in which the longitudinal seam of the can is welded.

Instead of destacking from the bottom of the stack of sheets as shown in the figures, the process according to the invention can also be carried out with destacking from the top of the stack of sheets. If need be, destacking can be effected optionally or systematically from bottom and top.

We claim:

1. Process for destacking individual metal sheets from a stack by means of at least two destacking members which seize the sheets from the stack, and for feeding the sheets into a conveyor line, characterized in that one destacking member seizes one metal sheet different from the other of the destacking members from the stack and without releasing the metal sheet holds the metal sheet in a position generally parallel to the position of the metal sheet in the stack during movement from the stack to a pair of feed rollers without interference or cooperation from other members or seized sheets, the feed rollers being positioned at a transfer position for transfer to the conveyor; and at least two sheets are engaged in the destacking process at any one time so that while one sheet is being positioned for transfer to the conveyor line, a destacking member is being moved to bring the next sheet to the feed rollers.

2. Process according to claim 1, characterized in that the destacking member positions each sheet on a table at the transfer position.

3. Process according to claim 1, characterized in that two destacking members are provided, and while one destacking member is positioning a sheet the other destacking member is being moved to ready the next sheet.

4. Process according to claim 1, characterized in that each destacking member executes a movement parallel with the plane of the sheet in the transfer position and a movement transverse to the said plane, so that each destacking member circumvents the sheet.

5. Process according to claim 1, characterized in that the stack has a top end and a bottom end; and the sheets are removed from one end of the stack.

6. A process for destacking according to claim 1, wherein the steps performed by each destacking member of seizing a metal sheet, and holding the metal sheet during movement from the stack to the transfer position are carried out in a can welding machine.

7. Device for destacking individual metal sheets from a stack and feeding the sheets into a conveyor line, characterized by at least two destacking members, each of the destacking members being operable to individually seize one metal sheet different from the other destacking members from the stack, and without releasing the sheet or rotating the sheet after being seized from the stack and being movable with the sheet without interference from any other member or seized sheet from the stack directly to a transfer position; and a transfer arrangement comprising a pair of feed rollers positioned at the transfer position to transfer the positioned sheets into the conveyor line.

8. Device according to claim 7, characterized in that has destacking member has controllable suction elements to releasably grip the sheet, and a table (16) is provided for supporting the sheet at the transfer position.

9. Device according to claim 7, characterized in that two destacking members (20,30) are provided, each provided with controllable suction elements to releasably grip a sheet.

10. Device according to claim 7, characterized in that the transfer arrangement is mounted in a can welding machine.

* * * * *

UNITED STATES PATENT AND TRADEMARK OFFICE

CERTIFICATE OF CORRECTION

PATENT NO. : 5,395,103

DATED : March 7, 1995

INVENTOR(S) : Peter Gysi, Armin Ineichen

It is certified that error appears in the above-identified patent and that said Letters Patent is hereby corrected as shown below:

On title page, item [30],
In the Foreign Application Priority Data, delete "01671/92", and insert --01671/92-7--.
Col. 4, line 54, delete "has" (first occurrence)

Col. 4, l. 55, - delete "(16)",

Col. 4, l. 59, - delete "(20,30)"

Signed and Sealed this

Nineteenth Day of September, 1995

*Attest:*

Bruce Lehman

BRUCE LEHMAN

*Attesting Officer*

*Commissioner of Patents and Trademarks*